US005784263A

United States Patent [19]

Nelson

[11] Patent Number: 5,784,263

[45] Date of Patent: Jul. 21, 1998

[54] CONNECTOR WITH ATTACHABLE DAUGHTER CARD RETENTION SYSTEM

[75] Inventor: Daryl James Nelson, Beaverton, Oreg.

[73] Assignee: Intel Corporation, Santa Clara, Calif.

[21] Appl. No.: 584,330

[22] Filed: Jan. 8, 1996

[51] Int. Cl.[6] ..... H01R 23/68; H01R 13/62

[52] U.S. Cl. ..... 361/785; 361/784; 361/792; 361/748; 439/328; 439/350

[58] Field of Search ..... 361/760, 753, 361/779, 784, 785, 788, 790, 792, 796, 683, 684, 748; 439/153–157, 325, 327, 328, 350

[56] References Cited

U.S. PATENT DOCUMENTS

| | | | |
|---|---|---|---|
| 5,002,498 | 3/1991 | Takahashi | 439/326 |
| 5,273,450 | 12/1993 | Renn et al. | 439/260 |
| 5,383,793 | 1/1995 | Hsu et al. | 439/327 |
| 5,413,497 | 5/1995 | Lwee | 439/328 |
| 5,542,854 | 8/1996 | Bowen | 439/157 |

*Primary Examiner*—Leo P. Picard
*Assistant Examiner*—Jayprakash N. Gandhi
*Attorney, Agent, or Firm*—Blakely, Sokoloff, Taylor & Zafman

[57] ABSTRACT

A printed circuit board retention system for supporting printed circuit boards in a computer chassis consists of a mother board located in the computer chassis and having a mother board connector mounted to it for connecting to a daughter card. The mother board connector has attachment points molded into it for optionally fastening a base support member. A daughter card including an edge card connection along the bottom edge for mating with the mother board connector such that the daughter card is positioned substantially at right angles to the mother board. A separate base support member may be fastened to the mother board by attachment points that mechanically mate with the attachment points on the mother board connector. The base support member has upwardly extending arms with clips on the ends. A partial frame element has downwardly extending arms with clips at the end that mate with the clips on the base support member arms. The base support member and the partial frame element surround the daughter card and provide mechanical support for it in the x,y and z axis. If such support is not needed, the connector is not burdened with the cost of the retention system.

13 Claims, 5 Drawing Sheets

CONNECTOR WITH ATTACHABLE DAUGHTER CARD RETENTION SYSTEM

BACKGROUND OF THE INVENTION

1. Field of The Invention

The present invention relates to circuit packaging for personal computers. More particularly, it relates to an apparatus for mechanically stabilizing and retaining daughter cards that are plugged onto a mother board.

2. Description of the Prior Art

The integrated circuit components of a personal computer are large boards having interconnect wiring called printed circuit boards or smaller versions called printed circuit cards. Most personal computer packaging consists of a single printed circuit board—most often referred to as a mother board that is mounted horizontally along the bottom of the computer chassis. A typical mother board provides the primary interconnections for the CPU and its support circuits, the memory—both RAM and ROM—the I/O interface and the system bus or busses. The mother boards have connectors mounted on their top side into which smaller printed circuit boards, often called daughter cards, may be plugged. Daughter cards have a connector located along one edge and are plugged in so that they are perpendicular to the mother board. In the past, daughter cards have been used primarily for expansion features such as sound I/O or video enhancements. However, daughter cards are now being used to house high performance CPUs.

In order for the computers to run trouble free, the connection between mother board and daughter card must be kept unbroken. In normal use this is not a problem. However, when a computer is moved or otherwise exposed to mechanical shock, and vibration the connectors may become disengaged. The shock may have components in a direction parallel to the mother board—hereafter referred to as shock in the x-y axis. Or the shock may have components in a direction parallel to the daughter card—hereafter referred to as shock in the z axis.

Prior personal computer manufacturers have recognized the need to prevent daughter cards from being disconnected due to mechanical shock, and have devised several retention systems for addressing this problem. For example, the mother board and daughter cards are housed in a rigid mechanical structure called a card cage which provides a frame to which daughter cards are attached by clips or screws. This is an effective but expensive solution. Other approaches require mounting holes in the mother board and notches or holes in the daughter card.

A less expensive approach is to do away with the card cage and retain the daughter card along the card edge on which the connecter is located. Indeed, connectors having a daughter card retention system built into them are now standard. These retention systems typically go the length of the card connector to allow the addition of card guides and latching features. Such retention systems are an integral part of the connector. They are inseparable. As a result, the integrated retention system adds cost to the connector. But, if the chassis into which the card is being incorporated has an independent retention system not requiring mechanical retention by the connector, the connector, is burdened by the additional cost of the redundant card retention system.

SUMMARY OF THE INVENTION

The present invention comprises a mother board having a connector that includes a connector housing mounted to it and a pc card having a bottom edge with connector mounted along that edge for mating with the connector on the mother board such that the pc card is positioned substantially at right angles to the mother board. A separate base support member fastens to the housing of the mother board connector housing or can additionally mount by fasteners to the mother board. A second mechanical fastener is connected to the pc card and mates with the mechanical fastener on the base support member. In a second embodiment, the separate base support member retains the pc card without the need of a second mechanical fastener on the card.

BRIEF DESCRIPTION OF THE DRAWING

The preferred embodiment will now be described in connection with the Drawing in which.

DESCRIPTION OF THE PREFERRED EMBODIMENT

The retention system according to the present invention utilizes a second piece, called a retainer, that snap attaches to the primary daughter card connector housing mounted on the mother board. In one embodiment, installation is permanent. In a second embodiment, the retainer may be removed after installation. The housing is modified with mounting tabs that do not add cost to the connector housing. The retainer snap attaches to the mother board connector housing after the mother board has been assembled and wave soldered. In instances where a retainer may not be required, as with some low profile chassis, the retainer is not installed and its expense is avoided. Attachment features are incorporated into the daughter card that allow it to snap into the retainer. At no additional cost, mounting tabs are provided at the ends of the retainer to facilitate a more robust attachment of the retainer to the mother board.

The latching system does not go the length of the connector. However, it provides a retention system that is integral to the connector but does not add cost or complexity directly to the connector itself. In one embodiment, the retention position is moved off the center line of the daughter card closer to the center of gravity of the daughter card and heat sink assembly.

Figure 2:
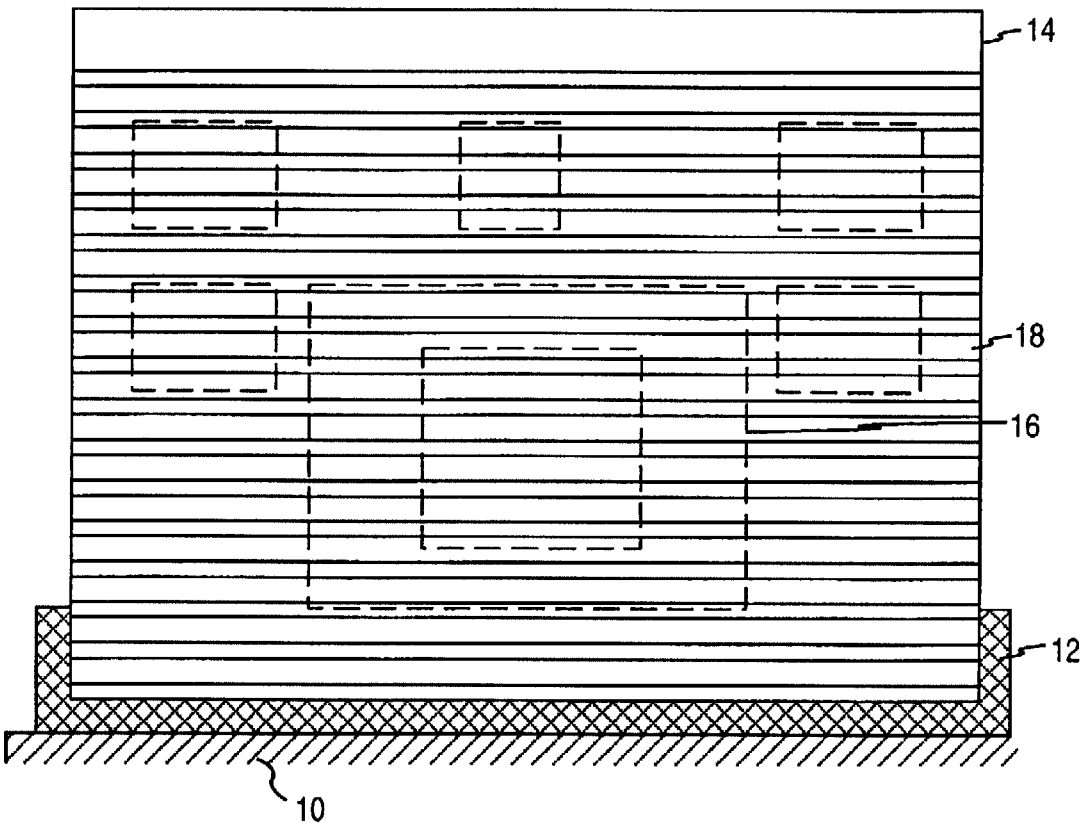
FIG. 2 is a front view of the same assembly of FIG. 1.
Figure 1:
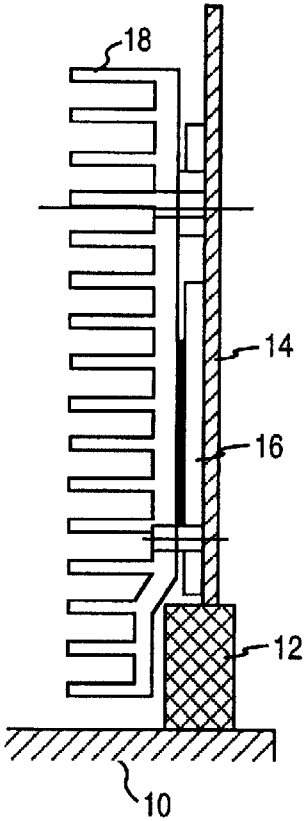
FIG. 1 is a side view of a daughter card and mother card assembly.

FIG. 1 is a side view of a daughter card and mother card assembly without the features of the present invention. FIG. 2 is a front view of the same assembly of FIG. 1. Referring now to FIGS. 1 and 2, a mother board 10 has mounted on it a connector system 12 which provides the electrical and mechanical interconnect between mother board 10 and a daughter card 14. Daughter card 14 in this case has a CPU or other high power chip 16 mounted on it which requires a heat sink 18 to cool chip 16.

Figure 3:
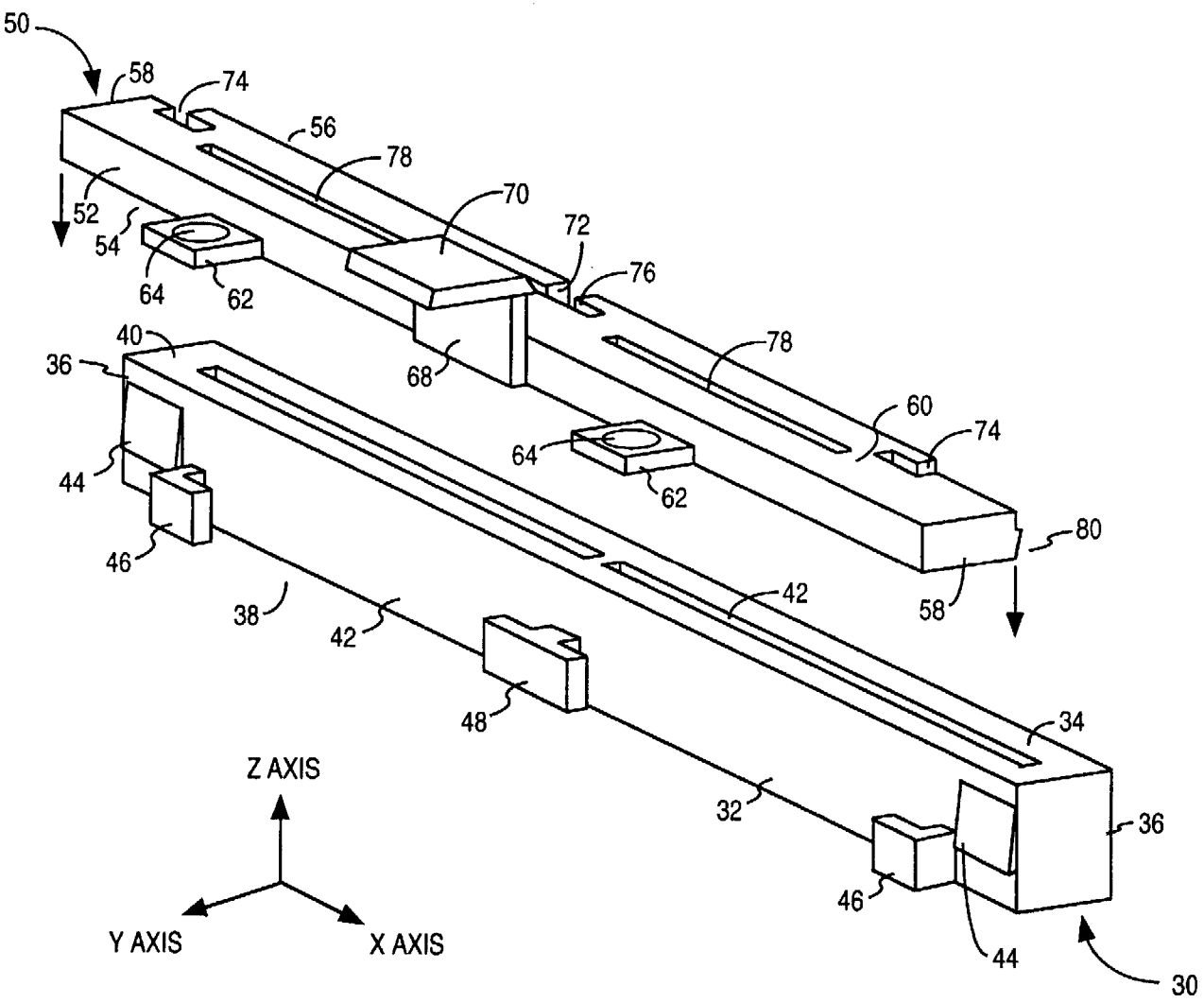
FIG. 3 is a perspective view of a retention system according to one embodiment of the present invention.

FIG. 3 is a perspective view of a retention system according to one embodiment of the present invention. Referring now to FIG. 3, connector housing 30 is rectangular in cross section and in top view and has a front surface 32, a back surface 34, end surfaces 36, bottom surface 38 and top surface 40. Connector housing 30 also has slots 42 that surround the electrical components (either pins or sockets) of the connector. Connector housing 30 has several attachment points. Specifically, connector housing 30 has flanges 44 extending outwardly from front surface 32 near either end 36. L-shaped tabs 46 extend outwardly from front surface 32 near tabs 44, and a T-shaped tab 48 extends outwardly from front surface 32 near the mid-point between end surfaces 36. Flanges 44, L-shaped tabs 46 and T-shaped tab 48 are preferably molded into connector housing 30 at the time of manufacture so that they represent no additional manufacturing cost. Connector housing 30 is fabricated from an insulating material, preferably a high temperature plastic such as PTC or PPS so that it can withstand reflow solder temperatures.

Retainer 50 is substantially rectangular in cross section and in top view and has a front surface 52, a bottom surface 54, a back surface 56 end surfaces 58 and a top surface 60. Retainer has mounting tabs 62 extending outwardly from front surface 52 which have screw holes 64 therein and are used for attaching retainer 50 to the mother board. This is to provide added stability in some chassis that may locate the connector in a position that allows amplified shock and vibration to the connector.

A latch assembly consists of an upright member 68 which extends outwardly from front surface 52 and has a portion 69 extending above top surface 60. A top member 70 extends at right angles from upright member 68 away from front surface 60. In addition, a catch portion 72 of top member 70 extends inwardly towards back surface 56.

Retainer 50 also has L-shaped cut out sections 74 located near end surfaces 58 and a T-shaped cutout 76 located near the mid-point between end surfaces 58. Retainer 50 has slots 78 running longitudinally along the center axis of regainer 50. The purpose of slots 78 are to add additional stability in the x and y axis. Back surface 56 has detents 80 extending outwardly therefrom adjacent end surfaces 58. Mounting tabs 62, the latch assembly detent 80 slots 78 and cutouts 74 and 76 are preferably formed by a molding process during fabrication. Retainer 50 is made from an insulating material, preferably an organic material. However, retainer 50 may be fabricated from a lower temperature material than that of connector housing 30 since it will not be exposed to soldering process temperatures.

In operation, connector housing 30 is mounted to the mother board 10 in the conventional manner. After mother board 10 is soldered, retainer 50 is snapped onto connector housing 30. Retainer 50 is positioned in the x-y axis by L-shaped cutouts 74 which slides over L-shaped tabs 46 and by T-shaped cutout 76 which slides over T-shaped tab 48. Flanges 44 snap over detents 80 and permanently capture retainer 50 in the z-axis.

Figure 4:
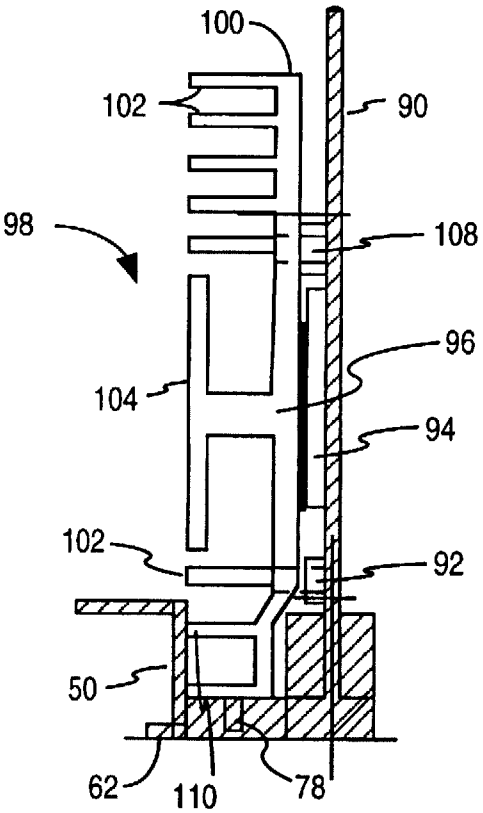
FIG. 4 is a side view of a daughter card assembly mounted in the retainer system of FIG. 3.

FIG. 4 is a side view of a daughter card assembly mounted in the retainer system of FIG. 3. Referring now to FIG. 4, connector housing 30 is attached to a mother board 10. Retainer 50 is positioned adjacent to connector housing 30. Daughter card 90 utilizes an edge card electrical connection 92 along its bottom edge and is inserted into slot 42 of connector housing 30 where it makes electrical contact with the electrical elements within connector housing 30. The side of a pc board or card on which components are mounted is referred to as the primary side. The reverse side is known as the secondary side. Daughter card 90 houses an integrated circuit chip 96. That is, integrated circuit 96 is mounted thereon. If integrated circuit chip 96 is a high performance chip, such as a P6 manufactured by Intel Corporation, a heat sink 98 will be required. Heat sink 98 comprises a base plate 100 which is positioned to be in contact with integrated circuit chip 96 from which it absorbs heat. Fins 102 extend outwardly from base plate 100 and provide extra surface area for dissipation of heat to ambient air. A T-shaped member 104 also extend outward from base plate 100. Its purpose is to provide additional heat transfer surface area and conduction paths from integrated circuit 96. Standoffs 108 provide support and attachment points for heat sink 98. Alternative heat sink attachment embodiments (not shown) include spring clips. Flange 110 is an extension of heat sink 98 which is stepped outward to avoid conflicting with connector housing 30 and rests on top surface 60 of retainer 50. Flange 110 also fits under catch 72 of top member 70.

The latch assembly consisting of upright member 68 and top member 70 may be finger activated, and disengages the daughter card attach point and allows removal of the daughter card assembly. The retainer system is designed for two hand card assembly removal. One hand grasps the card and the other hand unlatches the retainer by pressing down on top member 70. Then, both hands may be used to pull the card assembly out.

Figure 5:
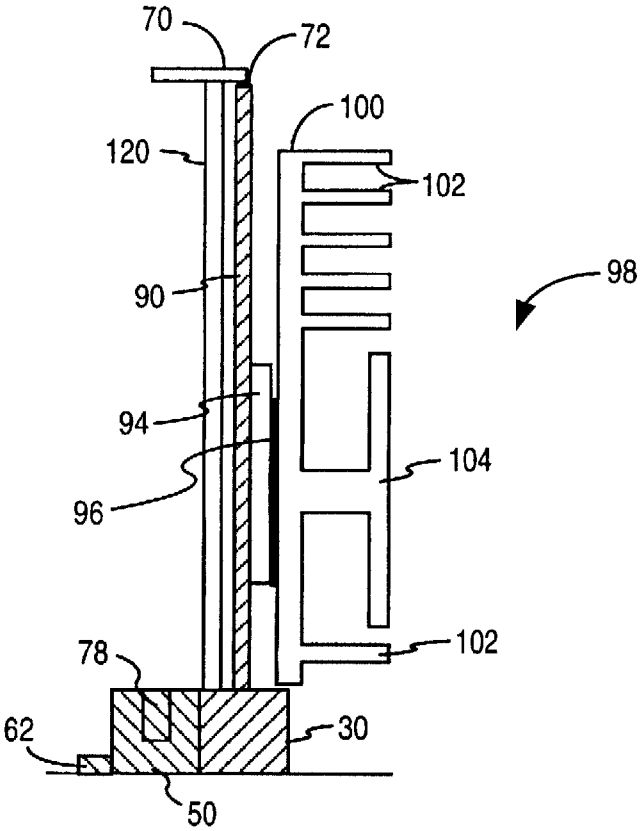
FIG. 5 is a side view of a daughter card mounted in alternative embodiment retainer wherein attachment to the daughter card is made on the secondary side of the daughter card.
Figure 6:
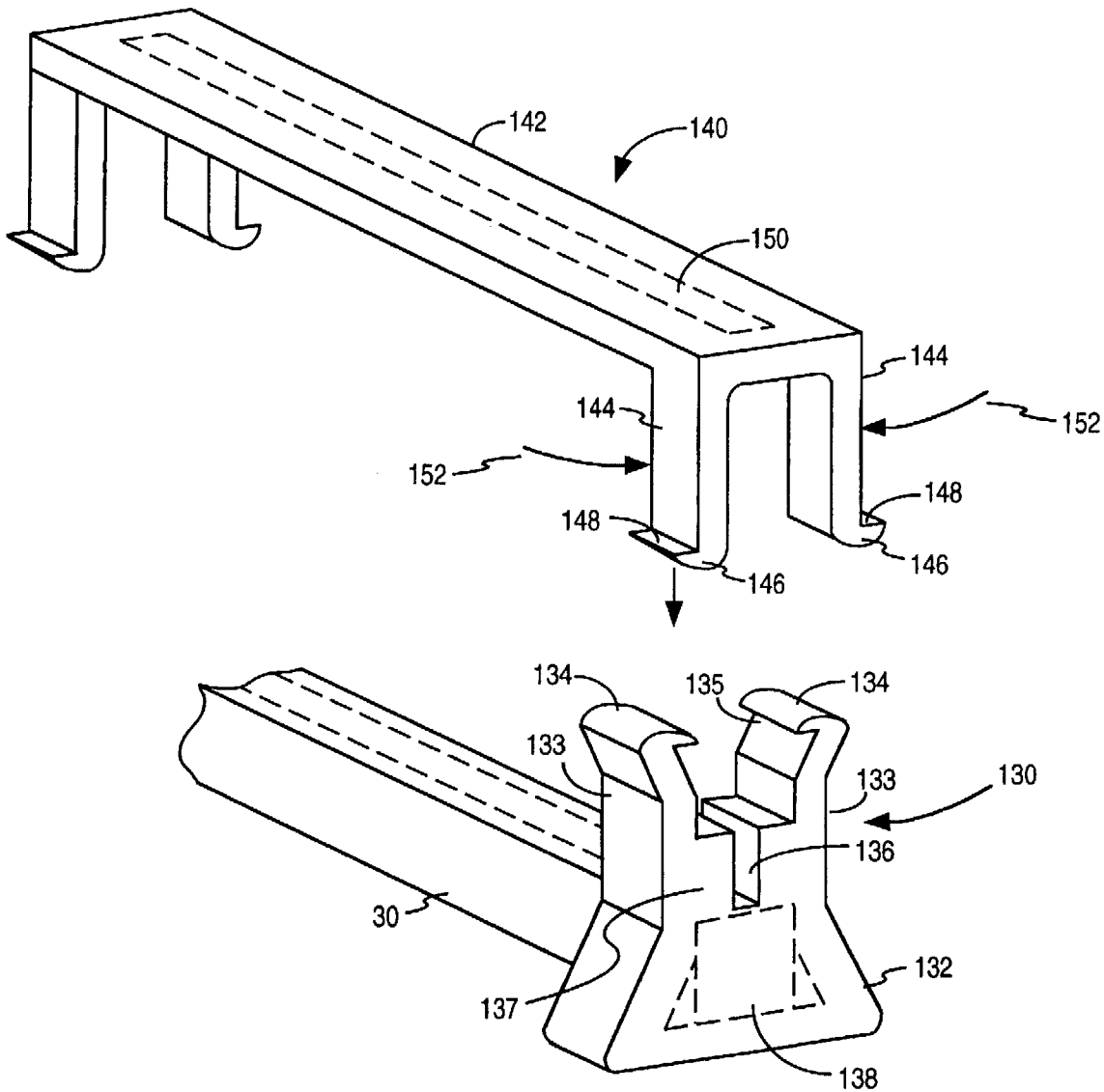
FIG. 6 is a perspective view of an alternative embodiment of the daughter card retainer system according to the present invention.

FIG. 5 is a side view of a daughter card mounted in an alternative embodiment of the invention wherein heat sink tabs are not needed as attachment points. Instead, a different latching arrangement is provided. Referring now to FIG. 5, upright member 120 extends along the secondary side of daughter card 90 to the top thereof. Catch 72 of top member 70 engages the top edge of daughter card 90. Ribs or other stiffeners may be added to upright member 120 to reduce rotation around the x axis and prevent disengagement of daughter card 90 from connector 30 during shock and vibration in the z-axis. The retainer is attached to the mother board using fasteners or permanently snap attached to the connector housing as previously described FIG. 6 is a perspective view of an alternative daughter card retainer system. Referring now to FIG. 6, the retainer system has an end unit 130 with a base portion 132 that surrounds connector housing 30 at either end of connector housing 30. Only one such base portion is shown in FIG. 6 for convenience. Two upward extending arm members 133 are attached to base portion 132 or are integral therewith. At the top end of each arm 133 is a clip 134 with inward facing latching surfaces 135. A daughter card guide consists of plane members 136 and 137 attached to arm member 133 but spaced apart to form a slot 138.

A frame element 140 has a top member 142 and an two arm elements 144 that are attached at right angles to top member 142 and extend downwardly. At the end of each arm 144, there is a clip 146 with outward facing latching surfaces 148. Top member 142 of frame element 140 may have a slot 150 for receiving the top edge of a daughter card. Clips 134 and clips 146 latch to each other by squeezing arms 144 together as indicated by arrows 152.

In operation, top member 142 of frame element 140 is fitted over the top edge of a daughter card with the top edge fitting into slot 150. Then frame element 140 with the daughter card is inserted into connector housing 130, its edges sliding into card guides 138 and the connector mounted on the lower edge of daughter card engages the electrical elements within connector housing 30. As clips 146 touch clips 134, arms 144 are squeezed together which allows clips 134 and 146 it snap together. To disengage the daughter card, merely squeeze arms 144 together until latching surfaces 135 and 148 disengage. Then lift up on frame element 140 and extract the daughter card.

Figure 7:
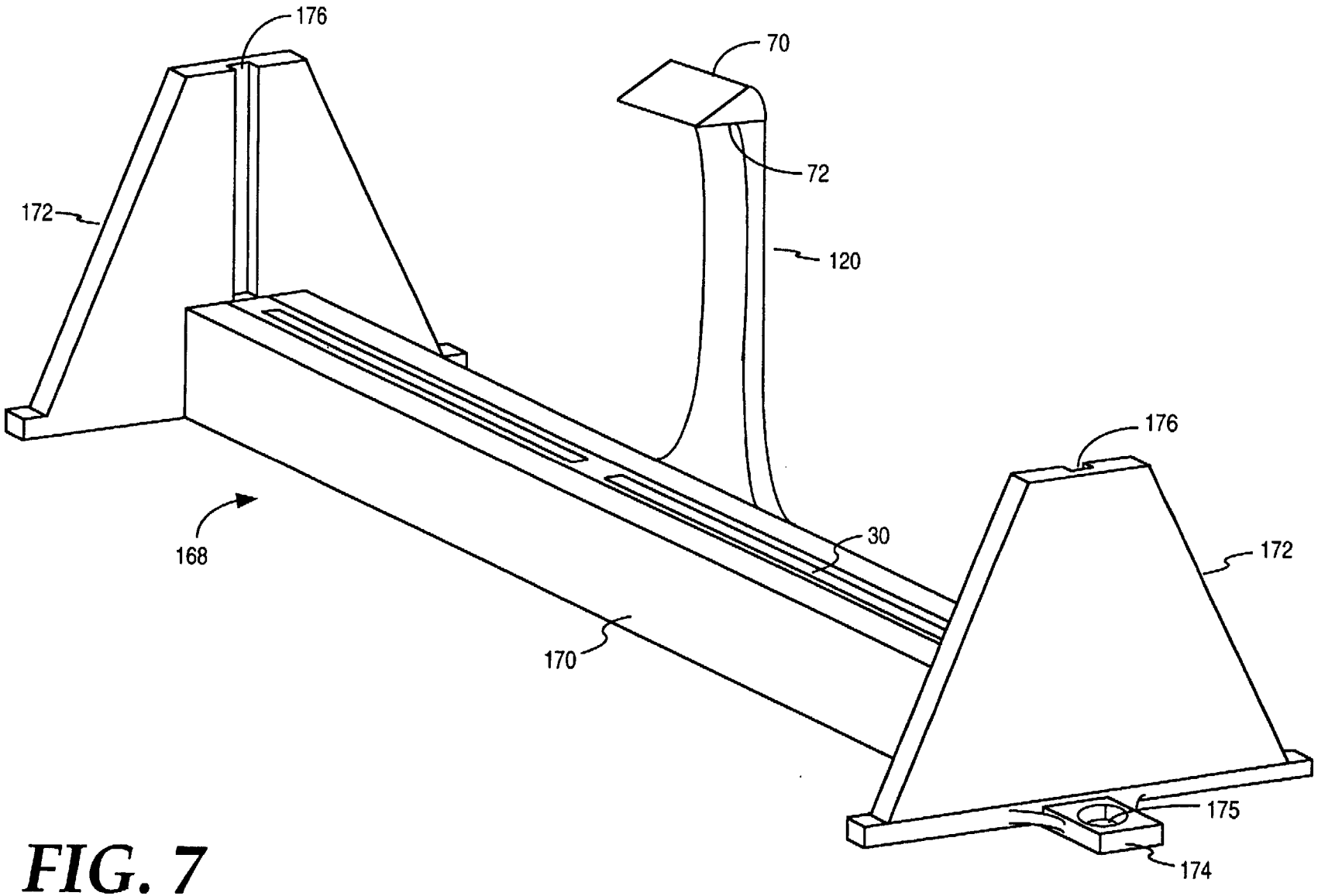
FIG. 7 is a perspective view of an alternative embodiment of a single piece daughter card retainer system according to the present invention.

FIG. 7 is a perspective view of yet another embodiment of the present invention. Referring now to FIG. 7, a retainer 168 consists of an elongated rectangular base member 170 has pyramidal end members 172 attached thereto at either end. A boss 174 with an annulus 175 on each end member provides attachment points for retainer 168 to mother board 10 (not shown). Base member 170 has a rectangular opening running its length which fits around connector housing 30. Upright member 120 is attached to base member 170 at or near the midpoint between end members 172. Upright member 120 extends to the top of daughter card 90 (not shown) and catch 72 of top member 70 engages the top edge of daughter card 90. Ribs or other stiffeners may be added to upright member 120 to reduce rotation around the x axis and prevent disengagement of daughter card 90 from connector 30 during shock and vibration in the z-axis. Alternative embodiments contemplate more than one upright member 120, and of varying thicknesses. Card guides 176 provide additional stability in the x and y direction. Upright member 120 may be made much wider than shown in order to add even more retention. Preferably, retainer 168 is fabricated in a singe molding process from a low cost plastic material.

A system has been shown for mechanical retaining a daughter card to a mother board that does not burden the daughter card to mother board electrical connector with the cost of the mechanical retention system. Thus, if a chassis retention system is not required, the system need not be used and the costs will be commensurately lower. The preferred embodiments just described are subject to numerous adaptations and modifications without departing from the concept of the invention. Therefore, within the scope of the appended claims, the invention may be practiced other than as specifically described herein.

. What is claimed is:

1. An apparatus comprising:

a first pc board;

a first connector portion mounted to said first pc board, said first connector portion including a housing having a first attachment point, a second pc board having a top, bottom and side edges and having a second connector mounted along said bottom edge for mating with said first connector portion such that said second pc board is positioned substantially at right angles to said first pc board;

a base support member independent of said first connector portion having a dimension thereof adjacent to said first pc board having a second attachment point adapted to mechanically mate with said first attachment point to affix said base support to said first pc board, said base member having fasteners thereon for mechanically holding said second Pc board at substantially right angles to said first pc board.

2. The printed circuit board connector system of claim 1 wherein said attachment to said second pc board is at said top edge and said side edges thereof.

3. The printed circuit board connector system of claim 1 wherein:

said base support member includes upward extending arms and said first attachment point comprises first clips at the upper extremity thereof;

said second pc board is substantially rectangular in plan view having four edges; and said mechanical fasteners comprises a partial frame element said top and side edges of said second pc board and wherein said second attachment point comprises clips attached thereto for mechanically mating with said first clips.

4. The printed circuit board connector system of claim 3 wherein said dimension of base member fastened to said mother board is wider than said arm portion.

5. The printed circuit board connector system of claim 4 wherein said arm portion is integral with said base member.

6. The printed circuit board connector system of claim 5 wherein said base member surrounds said first connector portion.

7. The printed circuit board connector system of claim 6 wherein said base member includes a slot substantially in line with said first connector portion for guiding said daughter board.

8. The printed circuit board connector system of claim 7 wherein said a partial frame element includes a slot for receiving said top edge of said daughter board.

9. The printed circuit board connector system of claim 8 wherein said base support member and said partial frame element is made of insulating material.

10. The printed circuit board connector system of claim 9 wherein said base support member is made from an organic material able to undergo flow solder temperatures without substantial deformation.

11. A printed circuit board connector system for supporting printed circuit boards in a computer chassis, comprising:

a mother board located in said computer chassis;

a first connector portion mounted to said mother board, said first connector portion including a housing having a first attachment point;

a daughter card having a bottom edge and second connector mounted along said bottom edge for mating with said first connector portion, said daughter card having a top edge substantially parallel to said bottom edge;

a heat sink mounted to said daughter board and having a flange thereon;

a base support member independent of said first connector portion having a dimension thereof adjacent to said first pc board having a second attachment point adapted to mechanically mate with said first attachment point to affix said base support to said first pc board, said base member having mechanical fasteners thereon for mating with said flange to provide mechanical support in a plane parallel to the plane of said daughter card.

12. An apparatus comprising:

a first pc board;

a first connector portion mounted to said first pc board, said first connector portion including a housing having a first attachment point;

a base support member independent of said first connector portion having a dimension thereof adjacent to said first pc board and having a second attachment point adapted to mechanically mate with said first attachment point to affix said base support to said first pc board, said base member having fasteners thereon for mechanically holding a second pc board at substantially right angles to said first pc board.

13. A method comprising the following steps:

mounting a first connector portion to a first pc board, said first connector portion being made of an insulating material capable of withstanding temperatures experienced in a solder reflow process, said first connector portion including a housing having a first attachment point;

reflow soldering said first pc board;

positioning a base support member such that a second attachment point thereon mate with said first attachment point on said first connector portion, said base member having fasteners thereon for mechanically holding a second pc board at substantially right angles to said first pc board.

snapping said first and second attachment points together.

* * * * *